United States Patent [19]

Ogihara et al.

[11] 4,376,994

[45] Mar. 15, 1983

[54] TIME DETECTING DEVICE FOR ALARM CLOCK

[75] Inventors: Masuo Ogihara; Nobuo Shinozaki; Tadashi Ishikawa; Yoichi Seki, all of Shikawatashi, Japan

[73] Assignee: Seiko Koki Kabushiki Kaisha, Japan

[21] Appl. No.: 218,184

[22] Filed: Dec. 19, 1980

[30] Foreign Application Priority Data

Jan. 17, 1980 [JP] Japan ..... 55-3943

[51] Int. Cl.[3] ..... G04B 23/02; G04C 21/16

[52] U.S. Cl. ..... 368/74; 368/254

[58] Field of Search ..... 368/250, 254, 109, 75, 368/74, 73

[56] References Cited

U.S. PATENT DOCUMENTS 4,069,658 1/1978 Ito ..... 368/254

4,212,155 7/1980 Ogihara et al. ..... 368/250

*Primary Examiner*—J. V. Truhe

*Assistant Examiner*—A. Evans

*Attorney, Agent, or Firm*—Robert E. Burns; Emmanuel J. Lobato; Bruce L. Adams

[57] ABSTRACT

The cam type time detecting mechanism of an alarm clock has a time gear wheel, an alarm gear wheel and a detecting plate, all mounted on a shaft. A hole is formed on either the alarm gear wheel or the detecting plate and a projection is formed on the other. The detecting plate is movable on the shaft in the axial direction of the shaft. The time gear wheel and the detecting plate have guiding parts respectively so that the time gear wheel, in its normal rotation, continuously pushes and turns the detecting plate. At least one of the time gear wheel, the alarm gear wheel and the detecting plate has a cam for lifting up the detecting plate if the time gear wheel and the alarm gear wheel turn either in normal and reverse directions.

3 Claims, 4 Drawing Figures

ALARM CONTROL CIRCUIT

TIME DETECTING DEVICE FOR ALARM CLOCK

BACKGROUND OF THE INVENTION

This invention relates to a time detecting device of an alarm clock and more particularly to the improvement of the alarm time detecting mechanism having a projection formed on either the time gear wheel or the alarm gear wheel and a cavity formed on the other.

In the conventional detecting mechanism of this type, the related parts of the projection and the cavity are formed by vertical faces to provide a high accuracy of detection in generating a detection signal when the projection falls into the cavity at an alarm time. Thus, in setting the conventional alarm mechanism, if the alarm gear wheel is turned in the direction that the vertical faces are engaged with the projection fallen into the cavity, the hour wheel is forcedly pushed and turned resulting in dislocation of time indication, or a part of the vertical faces is damaged when the hour gear wheel is hard to turn because of the resistance of the related gear trains. Accordingly, it is usual to provide a reversing check mechanism to prevent the turning of the gear wheels in the direction as described above. However, such mechanism still has disadvantages that the reversing check mechanism may be broken by mishandling, such as by forcedly turning the mechanism in the wrong direction, or a little reverse turning damages the vertical faces.

SUMMARY OF THE INVENTION

Accordingly, an object of the present invention is to provide a mechanism which is not damaged if the mechanism is turned in the reverse direction.

According to the present invention, the object is attained by providing, in addition to the hour gear wheel and the alarm gear wheel, a detecting plate which is mechanically shifted at alarm time detection and continuously pushed and turned by the hour gear wheel and further providing at least on either of the hour gear wheel, the alarm gear wheel or the detecting plate a cam which shifts the detecting plate in the direction to release the detecting plate from the detecting state when the alarm gear wheel is turned in either directions.

BRIEF DESCRIPTION OF THE DRAWINGS:

FIG. 3 is a partial sectional view of the embodiment of FIG. 1.

DETAILED DESCRIPTION OF THE INVENTION

Figure 1:
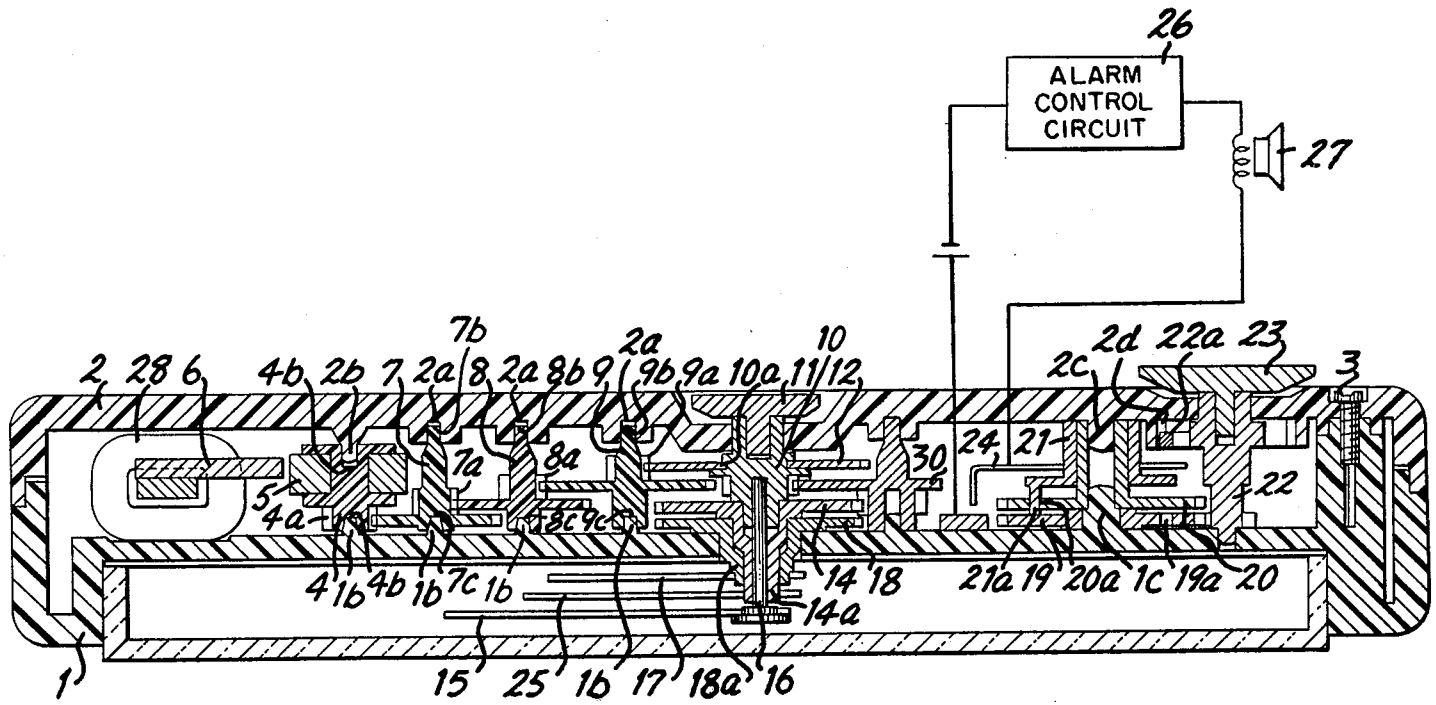
FIG. 1 is a sectional view of a preferred embodiment according to the present invention.
Figures 2, 3A, 3B:
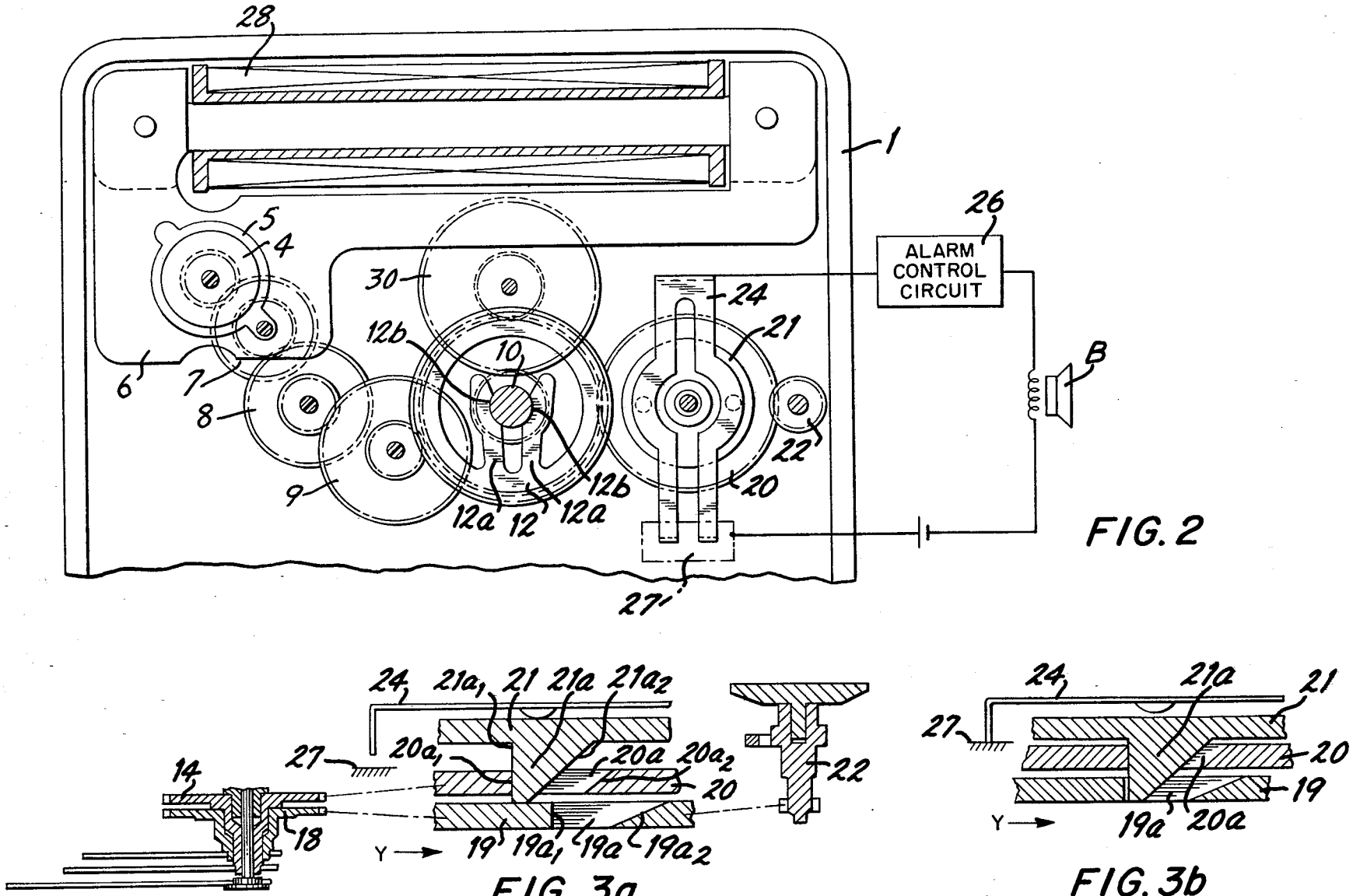
FIG. 2 is a plan view of the embodiment of FIG. 1.

Referring to attached drawings explanation will be made on the constitution of a preferred embodiment according to the present invention. In FIGS. 1 to 3, a top case 1 and a bottom case 2, each molded in plastic, are fastened together by screws 3. Holes 1*a* and 2*a*, and pivots 1*b* and 2*b* for rotatably holding gear wheels are formed inside of the respective cases. The outer configuration of the cases is formed in the appearance of a clock. A rotor wheel 4 molded in a plastic material and combined with a pinion 4*a* is provided with holes for receiving the pivots 1*b* and 2*b* formed on the cases 1 and 2. A magnet rotor 5 is fixed to the rotor wheel 4. The periphery of the magnet rotor 5 is magnetized in S-pole and N-pole at equal intervals. A stator 6 is alternately magnetized in S-pole and N-pole, for example every five seconds, by a coil 28 connected to a crystal oscillating circuit, not shown, and a frequency dividing circuit, not shown, so that the rotor wheel 4 is turned intermittently in one direction for an angle of 180° every five seconds. A second gear wheel 7, a third gear wheel 8 and a fourth gear wheel 9 are formed of a plastic material and provided with pinions 7*a*, 8*a* and 9*a*, pivot shafts 7*b*, 8*b* and 9*b* rotatably received in the corresponding holes 2*a* on the bottom case 2 and holes 7*c*, 8*c* and 9*c* rotatably receiving the corresponding pivots 1*b* on the top case 1, respectively. Thus the rotor wheel 4 and the gear wheels 7, 8 and 9 are pivoted on the top case 1 and the bottom case 2 and rotatable under low frictional resistance. One side of the shaft of a minute wheel 10 is rotatably supported on the bottom case 2, penetrates through the bottom case 2 and a knob 11 is fixed to the end. The other side of the shaft of the minute wheel 10 is rotatably supported by the inner surface of the pipe shaft 14*a* of an hour gear wheel 14. The minute gear core 10 has a groove 10*a* in its middle part. A minute hand shaft 16 fixed to a minute hand 15 is force-fit in the bore of the minute gear core 10. A minute gear wheel 12 is engaged with the pinion 9*a* fixed to the fourth gear wheel 9 and provided with two resilient arms 12*a* each having a portion formed in an arc of a circle. The resilient arms 12*a* are fitted in the groove 10*a*, thus the minute gear core 10 and the minute gear wheel 12 are joined by the slip mechanism which is well known as one of clock mechanisms. The hour gear wheel 14 is engaged with the minute gear core 10 through an intermediate hour wheel 30. The pipe shaft of the hour gear wheel 14 is rotatably supported by the inner periphery of and extending through the pipe shaft of an alarm gear wheel 18. An hour hand 25 is fixed to the end of the pipe shaft of the hour gear wheel 14. The pipe shaft 18*a* of the alarm gear wheel 18 is rotatably supported by and penetrates through the top case 1. An alarm hand 17 is fixed to the end of the pipe shaft 18*a* projecting through the top case 1. A second alarm gear wheel 19 engaging with the alarm gear wheel 18 is rotatable about a stud shaft 1*c* formed on the top case 1. Two cam holes 19*a*, each having a vertical face $19a_1$ on one end and an inclined face $19a_2$ on the opposite end, are formed on the second alarm gear wheel 19 at different radiuses respectively as shown in FIG. 3. A second hour gear wheel 20 engaging with the hour gear wheel 14 and being rotatable about a pivot 1*c* on the top case 1 and a pivot 2*c* on the bottom case 2 is disposed above the second alarm gear wheel 19 and provided with two cam holes 20*a* corresponding to the respective cam holes 19*a* of the second alarm gear wheel 19. Each cam holes 20*a*, similarly to the cam hole 19*a*, has a vertical face $20a_1$ on one end and an inclined face $20a_2$ on the opposite end. A detecting plate 21 is rotatably and axially shiftably supported on the pipe shaft of the second hour gear wheel 20 and provided with two cams 21*a* corresponding to the cam holes 20*a* of the second hour gear wheel and the cam holes 19*a* of the second alarm gear wheel 19. Normally, the cams 21*a* penetrate through the respective cam holes 20*a* of the second hour gear wheel 20 and in sliding contact with the face of the second alarm gear wheel 19. One face of each cam 21*a* is formed in a vertical guide face $21a_1$ and the opposite face is formed in an inclined face $21a_2$. An alarm setting core 22 is engaged with the second alarm gear wheel 19 and provided at the upper part with a resilient arm 22*a* engaging with a click 2*d* formed on the bottom case 2. To the upper end of the alarm setting core 22 projecting through the bottom case 2, an alarm time setting knob 23 is fixed. A lifting spring 24 is related with the detecting plate 21. Normally, the lifting spring 24 is kept at an upper position by the detecting plate 21 and when the cams 21*a* of the detecting plate 21 dropped into the corresponding cam holes 19*a* of the second alarm gear wheels 19, the lifting spring is allowed to move downward to come in contact with a fixed contact point 27 of an alarm control circuit 26 so that the alarm generating circuit is closed and a buzzer (B) is actuated.

The manner of operation of the described mechanism will be explained hereunder. The mechanism of the clockwork will be briefly described as it is similar to the common electric clocks.

The direction of the electric current (i) supplied to the coil 28 is reversed alternately every five seconds to magnetize the stator 6 in S-pole and N-pole alternately so that the magnet rotor 4 is turned intermittently in one direction for an angle of 180° every five seconds. The turning of the magnet rotor 4 is transmitted to the minute gear wheel 12 through the second gear 7, the third gear 8 and the fourth gear 9. Normally, the minute gear wheel 12 is turned at a rate of one round an hour together with the minute gear core 10. The turning of the minute gear core 10 is transmitted to the hour gear wheel 14 through the intermediate hour gear wheel 30. The turning of the hour gear wheel 14 is transmitted to the second hour gear wheel 20. The hour gear wheel 14 and the second hour gear wheel 20 turn at a rate of one round per twelve hours.

In operation of the alarm mechanism, first the setting knob 23 is turned to set the alarm hand to a desired time. The phase of the second alarm gear wheel 19 alos is determined with the setting of the alarm hand. In this setting procedure, the conventional alarm clocks have the disadvantage that the setting knob 23 is allowed to be turned only in one direction, the direction to turn the alarm gear wheel 18 in the direction reverse to the direction of the turning of the hour gear wheel 14. The present invention allows the turning of the setting knob 23 irrespective of the direction without the possibility of damaging the cam 21*a* as the inclined faces 21$a_2$, 20$a_2$ and 19$a_2$ are formed on the detecting plate 21, the second hour gear wheel 20 and the second alarm gear wheel 19 respectively. More detailed explanation will be provided hereunder starting from the state as shown in FIG. 3-*b* where the detecting plate 21 as shifted in the direction toward the second alarm gear wheel 19. When the second alarm gear wheel 19 is turned in the direction as shown by the arrow (Y) starting from the state as shown in FIG. 3-*b*, the vertical face 19$a_1$ of the second alarm gear wheel 19 comes in contact with the vertical guide face 21$a_1$ of the detecting plate 21 and starts turning the detecting plate 21, and then the inclined face 21$a_2$ of the detecting plate 21 is brought into contact with the inclined face 20$a_2$ of the second hour gear wheel 20 so that the detecting plate 21 is pushed up by the sliding engagement of the inclined faces 21$a_2$ and 20$a_2$ according to successive turning of the second alarm gear wheel 19 and finally, the second alarm gear wheel 19 and the detecting plate 21 are disengaged. Thus the mechanism according to the present invention is constituted so that the inclined faces 19$a_2$, 20$a_2$ and 21$a_2$ function if the second alarm gear wheel 19 is turned in the normal or reverse direction, therefore, the vertical guide face and the related parts are not damaged as the alarm gear wheel and the others are not forcedly pushed and turned. When the second hour gear wheel 20 is turned in the direction reverse to the direction as shown by the arrow (Y) by operating the time correction knob 11, the inclined face 20$a_2$ of the second hour gear wheel 20 pushes up the detecting plate 21 to release the engagement between the detecting plate 21 and the second alarm gear wheel 19 providing the same effect as described hereinbefore.

During the operation of the alarm clock with an alarm time set, the rotor 4 turns the second hour wheel 20, which pushes and turns the detecting plate 21 as shown in FIG. 3-*a*. At the alarm time previously set, the phases of the vertical guide face 21$a_1$ of the detecting plate 21 and the vertical face 19$a_1$ of the second alarm gear wheel coincide so that the detecting plate 21 is shifted downward by being urged by the lifting spring 24 and the lifting spring comes in contact with the fixed contact point 27 as shown in FIG. 3-*b* to close the alarm circuit actuating the buzzer (B). The buzzing can be stopped by operating a stop switch, not shown, included in the alarm circuit. If the buzzing is not intentionally stopped, the second hour gear wheel 20 continues to push and turn the detecting plate 21 for a fixed period of time, then the inclined face 21$a_2$ comes in contact with the inclined face 19$a_2$ of the second alarm gear wheel 19 and the detecting plate 21 is pushed up in the manner as hereinbefore described so that the detecting plate 21 is released from the second alarm gear wheel 19 and the lifting spring 24 is pushed up to be separated from the fixed contact point 27, thus stopping the buzzer (B). Although the embodiment has been described as applied to a two-hands type alarm clock, it is obvious that the mechanism of the present invention can be applied to the alarm time detecting mechanism for the leaf-type digital clock. In the constitution of the mechanism hereinbefore described, the detecting plate is turned together with the hour gear wheel, however, the same effect can be provided by constituting the mechanism to make the detecting plate turn together with the alarm gear wheel.

It will be obvious from what has been described hereinbefore that the object of the present invention is attained by the mechanism according to the present invention, besides the accessability of time correction and alarm time setting operations is improved as the alarm time setting knob and the time correction knob are allowed to be turned in either directions.

We claim:

1. A time detecting device comprising an hour gear wheel for indicating time, an alarm gear wheel for indicating an alarm time and a detecting device for actuating an alarm device by mechanically shifting when the phases of said hour gear wheel and said alarm gear wheel coincide, characterized by a detecting plate supported coaxially with said hour gear wheel and said alarm gear wheel and adapted to be shiftable in the axial direction, guiding parts formed on said hour gear wheel and said detecting plate respectively for pushing and turning said detecting plate as said hour gear wheel turns in the normal direction, a hole and a projection formed on said alarm gear wheel and said detecting plate respectively for detecting the time and a cam face or cam faces formed at least on either said hour gear wheel, said alarm gear wheel or said detecting plate for pushing up said detecting plate in the direction to release the engagement between said hole and said projection irrespective of direction of turning of said alarm gear wheel.

2. A time detecting device as set forth in claim 1 wherein a second hour gear wheel and a second alarm gear wheel engaging with said hour gear wheel and said alarm gear wheel respectively being provided, said detecting plate being supported coaxially with said second hour gear wheel and said second alarm gear wheel, said guiding parts being formed on both detecting plate and said second hour gear wheel, said hole and said projection being formed on said second alarm gear wheel and said detecting plate respectively, and said cam face being formed at least on either said second hour gear wheel, said second alarm gear wheel or said detecting plate.

3. A time detecting device as set forth in claim 1 or 2 wherein a lifting spring being provided for urging said detecting plate toward said alarm gear wheel or said second alarm gear wheel, a fixed contact point being provided so as to come in contact with said lifting spring when said detecting plate is shifted toward said alarm gear wheel or said second alarm gear wheel, and said fixed contact point and said lifting spring being connected to an alarm controlling circuit.

* * * * *